US007836949B2

(12) United States Patent
Dykstra

(10) Patent No.: US 7,836,949 B2
(45) Date of Patent: Nov. 23, 2010

(54) METHOD AND APPARATUS FOR CONTROLLING THE MANUFACTURE OF WELL TREATMENT FLUID

(75) Inventor: Jason D. Dykstra, Addison, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 397 days.

(21) Appl. No.: 11/691,623

(22) Filed: Mar. 27, 2007

(65) Prior Publication Data

US 2008/0236818 A1 Oct. 2, 2008

Related U.S. Application Data

(63) Continuation-in-part of application No. 11/291,496, filed on Dec. 1, 2005.

(51) Int. Cl.
*E21B 43/12* (2006.01)
*E21B 47/00* (2006.01)

(52) U.S. Cl. ..... 166/250.15; 166/53; 166/75.15; 166/90.1

(58) Field of Classification Search ..... None
See application file for complete search history.

(56) References Cited

U.S. PATENT DOCUMENTS

| | | | |
|---|---|---|---|
| 2,758,653 | A | 8/1956 | Desbrow |
| 2,953,460 | A | 9/1960 | Baker |
| 2,980,291 | A | 4/1961 | Schuerger |
| 3,062,286 | A | 11/1962 | Wyllie |
| 3,455,391 | A | 7/1969 | Matthews |
| 3,537,529 | A | 11/1970 | Timmerman |
| 3,556,218 | A | 1/1971 | Talley |
| 3,578,080 | A | 5/1971 | Closmann |
| 3,682,246 | A | 8/1972 | Closmann |

(Continued)

FOREIGN PATENT DOCUMENTS

EP 0124251 11/1984

(Continued)

OTHER PUBLICATIONS

Warpinski, Norman R and Branagan, Paul T., "Altered Stress Fracturing", JPT, 990-97, 473-476, 1989.

(Continued)

*Primary Examiner*—Zakiya W. Bates
(74) *Attorney, Agent, or Firm*—John W. Wustenberg; Baker Botts L.L.P.

(57) ABSTRACT

A method and apparatus for controlling the production of well treatment fluid is disclosed. The apparatus includes: a sand system, a water system, a pumping system, a blender tub, and a virtual rate control system. The method includes determining an output rate from a sand system; sensing an output rate from a water system; sensing an output rate from a pumping system; sensing the height within a blender tub of a mixture of sand from the sand system and water from the water system; providing a virtual rate control system; and producing a drive signal to the pumping system using the virtual rate control system using a desired rate of well treatment fluid to be delivered to a well, the output rate of the sand system, the output rate of the water system, and the output rate of the pumping system.

14 Claims, 4 Drawing Sheets

U.S. PATENT DOCUMENTS

| | | | | |
|---|---|---|---|---|
| 3,822,747 | A | 7/1974 | Maguire | |
| 3,933,205 | A | 1/1976 | Kiel | |
| 4,050,529 | A | 9/1977 | Tagirov et al. | |
| 4,137,970 | A | 2/1979 | Laflin et al. | |
| 4,209,278 | A | 6/1980 | Cooper et al. | |
| 4,265,266 | A | 5/1981 | Kierbow et al. | |
| 4,305,463 | A | 12/1981 | Zakiewicz | |
| 4,353,482 | A | 10/1982 | Tomlinson et al. | |
| 4,409,927 | A | 10/1983 | Loesch et al. | |
| 4,410,106 | A | 10/1983 | Kierbow et al. | |
| 4,427,133 | A | 1/1984 | Kierbow et al. | |
| 4,635,723 | A | 1/1987 | Spivey | |
| 4,701,095 | A | 10/1987 | Berryman et al. | |
| 4,715,721 | A | 12/1987 | Walker et al. | |
| 4,724,905 | A | 2/1988 | Uhri | |
| 4,733,567 | A | 3/1988 | Serata | |
| 4,830,106 | A | 5/1989 | Uhri | |
| 4,845,981 | A | 7/1989 | Pearson | |
| 4,850,750 | A | 7/1989 | Cogbill et al. | |
| 4,974,675 | A | 12/1990 | Austin et al. | |
| 5,014,218 | A | 5/1991 | Crain et al. | |
| 5,111,881 | A | 5/1992 | Soliman et al. | |
| 5,228,510 | A | 7/1993 | Jennings, Jr. | |
| 5,245,548 | A | 9/1993 | Kuan | |
| 5,281,023 | A | 1/1994 | Cedillo et al. | 366/17 |
| 5,365,435 | A | 11/1994 | Stephenson | 700/265 |
| 5,417,283 | A | 5/1995 | Ejiogu et al. | |
| 5,494,103 | A | 2/1996 | Surjaatmadja et al. | |
| 5,499,678 | A | 3/1996 | Surjaatmadja et al. | |
| 5,515,920 | A | 5/1996 | Luk et al. | |
| 5,574,218 | A | 11/1996 | Withers | |
| 5,659,480 | A | 8/1997 | Anderson et al. | |
| 6,120,175 | A | 9/2000 | Tewell | |
| 6,193,402 | B1 | 2/2001 | Grimland et al. | |
| 6,236,894 | B1 | 5/2001 | Stoisits et al. | |
| 6,394,184 | B2 | 5/2002 | Tolman et al. | |
| 6,575,247 | B2 | 6/2003 | Tolman et al. | |
| 6,644,844 | B2 | 11/2003 | Neal et al. | |
| 6,729,394 | B1 | 5/2004 | Hassan et al. | |
| 6,935,424 | B2 | 8/2005 | Lehman | |
| 6,991,037 | B2 | 1/2006 | Hockinig | |
| 7,036,587 | B2 | 5/2006 | Munoz, Jr. et al. | |
| 7,143,832 | B2 | 12/2006 | Freyer | |
| 7,225,869 | B2 | 6/2007 | Willett, et al. | |
| 7,243,726 | B2 | 7/2007 | Ohmer | |
| 7,367,411 | B2 | 5/2008 | Leuchtenberg | |
| 7,391,675 | B2 | 6/2008 | Drew | |
| 7,431,090 | B2 | 10/2008 | Surjaatmadja, et al. | |
| 7,445,045 | B2 | 11/2008 | East, Jr. et al. | |
| 7,711,487 | B2 | 5/2010 | Surjaatmadja | |
| 2002/0125011 | A1 | 9/2002 | Snider et al. | |
| 2003/0050758 | A1 | 3/2003 | Soliman et al. | |
| 2003/0141064 | A1 | 7/2003 | Roberson, Jr. | |
| 2004/0020662 | A1 | 2/2004 | Freyer | 166/387 |
| 2005/0121196 | A1 | 6/2005 | East et al. | |
| 2005/0211439 | A1 | 9/2005 | Willett et al. | |
| 2006/0081412 | A1 | 4/2006 | Wright et al. | |
| 2006/0161358 | A1 | 7/2006 | Dykstra et al. | |
| 2006/0185848 | A1 | 8/2006 | Surjaatmadja et al. | |
| 2006/0243437 | A1 | 11/2006 | Albers et al. | |
| 2006/0289167 | A1 | 12/2006 | Surjaatmadja et al. | |
| 2007/0116546 | A1 | 5/2007 | Dearing | |
| 2007/0125543 | A1 | 6/2007 | McNeel et al. | |
| 2007/0125544 | A1 | 6/2007 | Robinson | |
| 2007/0153622 | A1 | 7/2007 | Dykstra et al. | 366/8 |
| 2007/0153623 | A1 | 7/2007 | Dykstra et al. | 366/8 |
| 2007/0153624 | A1 | 7/2007 | Dykstra et al. | 366/19 |
| 2007/0171765 | A1 | 7/2007 | Dykstra et al. | 366/19 |
| 2007/0201305 | A1 | 8/2007 | Heilman et al. | |
| 2008/0083531 | A1 | 4/2008 | Surjaatmadja | |
| 2008/0083532 | A1 | 4/2008 | Surjaatmadja | 166/250.1 |
| 2008/0083538 | A1 | 4/2008 | Soliman | |
| 2008/0236818 | A1 | 10/2008 | Dykstra | 166/252.1 |
| 2009/0050311 | A1 | 2/2009 | Crawford | |
| 2009/0194273 | A1 | 8/2009 | Surjaatmadja | |

FOREIGN PATENT DOCUMENTS

| | | | |
|---|---|---|---|
| EP | 0508817 | | 10/1991 |
| EP | 0474350 | | 3/1992 |
| GB | 1460647 | A | 1/1977 |
| NO | 20042134 | | 11/2005 |
| WO | WO 2004/007894 | | 1/2004 |
| WO | WO 2006/109035 | A | 10/2006 |
| WO | WO 2007/024383 | A2 | 3/2007 |
| WO | WO2008/041010 | A1 | 4/2008 |
| WO | WO2008/142406 | A3 | 11/2008 |

OTHER PUBLICATIONS

Surjaatmadja, "Single Point of Initiation, Dual-Fracture Placement for Maximizing Well Production," 2007 Society of Petroleum Engineers, SPE 107718.

Surjaatmadja, "The Important Second Fracture and its Operational Placement for Maximizing Production," Society of Petroleum Engineers SPE 107059, 2007.

Surjaatmadja, "The Mythical Second Fracture and its Operational Placement for Maximizing Production," Society of Petroleum Engineers SPE 106046, 2007.

U.S. Appl. No. 11/323,831, Jason Dykstra.

U.S. Appl. No. 11/323,323, Jason Dykstra.

U.S. Appl. No. 11/323,322, Jason Dykstra.

U.S. Appl. No. 11/323,324, Jason Dykstra.

Office Action for U.S. Appl. No. 11/291,496, filed May 3, 2007.

International Search Report for International Application No. PCT/GB2007/001189, Sep. 5, 2007.

Office Action for U.S. Appl. No. 11/291,496, filed Oct. 16, 2007.

International Search Report for International Application No. PCT/GB2008/001044, Aug. 13, 2008.

International Preliminary Report on Patentability from PCT/GB2008/001044, dated Oct. 8, 2009.

Surjaatmadja et al., "Consideration for Future Stimulation Options is Vital in Deciding Horizontal Well Drilling and Completion Schemes for Production Optimization," Society of Petroleum Engineers, 2006, SPE 103774.

Search Report and Written Opinion for International Application No. PCT/GB2008/001730 dated May 21, 2008.

METHOD AND APPARATUS FOR CONTROLLING THE MANUFACTURE OF WELL TREATMENT FLUID

CROSS-REFERENCE TO RELATED APPLICATIONS

This application is a continuation-in-part of copending application Ser. No. 11/291,496 filed Dec. 1, 2005.

FIELD OF THE INVENTION

The present invention relates generally to well operations, and more particularly to methods and apparatuses for controlling the manufacturing of well treatment fluid

BACKGROUND

In the production of oil and gas in the field, several input systems are often required to manufacture and deliver an appropriate well treatment fluid to a well formation. Considerations, such as treatment fluid composition, density, and flow rate can be critical in the stimulation of production site. A typical well stimulation operation includes a proppant or sand system, a water system, a resin system, a gel system, a blending tub, and a pumping system. These systems are often individually controlled.

It is often required to coordinate the operation of the various subsystems. Currently, much of the equipment is controlled independently with passed setpoint data and with no direct consideration of the subsystem physical dynamics. Because current well treatment subsystems often operate independently, some systems may be running ahead or behind of other systems. Without interconnectivity and the ability to compensate for this type of phenomena, this can lead to well treatment fluid that does not comply with the needs of a well formation.

SUMMARY

According to one embodiment of the present invention, a method for controlling the production of well treatment fluid is disclosed that includes the steps of determining an output rate from a sand system sensing an output rate from a water system; sensing an output rate from a pumping system; sensing the height within a blender tub of a mixture of sand from the sand system and water from the water system; providing a virtual rate control system; and producing a drive signal to the pumping system using the virtual rate control system using a desired rate of well treatment fluid to be delivered to a well, the output rate of the sand system, the output rate of the water system, and the output rate of the pumping system.

Certain embodiments may provide a number of technical advantages. For example, a technical advantage of one embodiment may include the ability to coordinate the various subsystems in a well treatment operation so that consistent performance be maintained according to a desired output rate or output property. Another technical advantage of other embodiments include the ability to monitor the production of a well treatment fluid in real time. An advantage of other embodiments includes the ability to change a desired property of a well treatment fluid and to automatically propagate the change throughout the well treatment fluid production process. In addition, some embodiments provide the technical advantage of each input system being able to account for system dynamics.

Although specific advantages have been enumerated above, various embodiments may include all, some, or none of the enumerated advantages. Additionally, other technical advantages may become readily apparent to one of ordinary skill in the art after review of the following figures, description, and claims.

BRIEF DESCRIPTION OF THE DRAWINGS

A more complete understanding of the present disclosure and advantages thereof may be acquired by referring to the following description taken in conjunction with the accompanying drawings. The drawings illustrate only exemplary embodiments and are not intended to be limiting against the invention.

DETAILED DESCRIPTION

The details of the methods and apparatuses according to the present invention will now be described with reference to the accompanying drawings.

Figure 1:
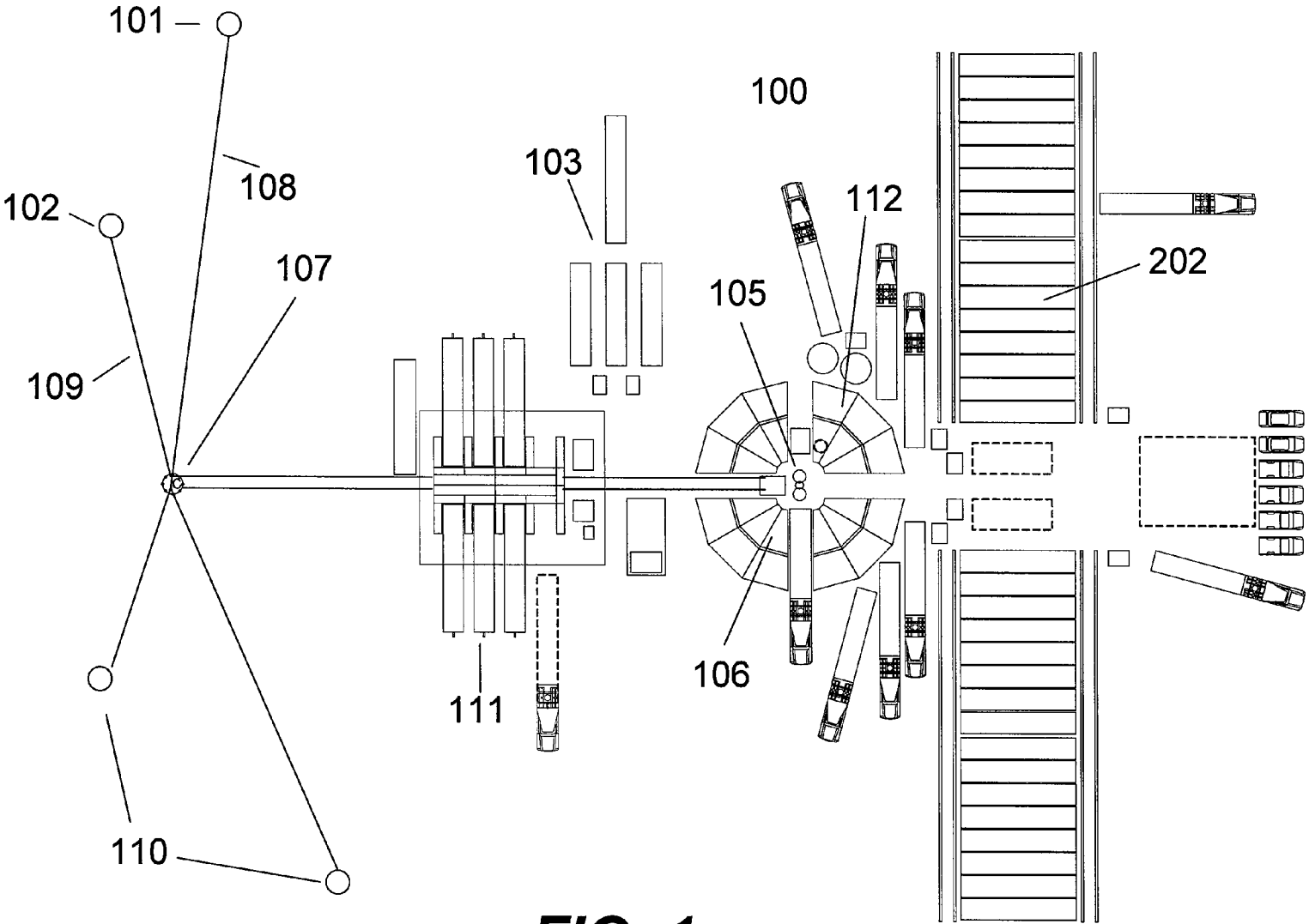
FIG. 1 is a diagram of a centralized well treatment facility.

In reference to FIG. 1, in one embodiment, a well treatment operations factory 100 includes one or more of the following: a centralized power unit 103; a pumping grid 111; a central manifold 107; a proppant storage system 106; a chemical storage system 112; and a blending unit 105. In this and other embodiments, the well treatment factory may be set upon a pad from which many other wellheads on other pads 110 may be serviced. The well treatment operations factory may be connected via the central manifold 107 to at least a first pad 101 containing one or more wellheads via a first connection 108 and at least a second pad 102 containing one or more wellheads via a second connection 109. The connection may be a standard piping or tubing known to one of ordinary skill in the art. The factory may be open, or it may be enclosed at its location in various combinations of structures including a supported fabric structure, a collapsible structure, a prefabricated structure, a retractable structure, a composite structure, a temporary building, a prefabricated wall and roof unit, a deployable structure, a modular structure, a preformed structure, or a mobile accommodation unit. The factory may be circular and may incorporate alleyways for maintenance access and process fluid flow. The factory, and any or all of its components can be climate controlled, air ventilated and filtered, and/or heated. The heating can be accomplished with radiators, heat plumbing, natural gas heaters, electric heaters, diesel heaters, or other known equivalent devices. The heating can be accomplished by convection, radiation, conduction, or other known equivalent methods.

In one embodiment of the centralized power unit 103, the unit provides electrical power to all of the subunits within the well operations factory 100 via electrical connections. The centralized power unit 103 can be powered by liquid fuel, natural gas, or other equivalent fuel and may optionally be a cogeneration power unit. The unit may comprise a single trailer with subunits, each subunit with the ability to operate independently. The unit may also be operable to extend power to one or more outlying wellheads.

In one embodiment, the proppant storage system 106 is connected to the blending unit 105 and includes automatic valves and a set of tanks that contain proppant. Each tank can be monitored for level, material weight, and the rate at which proppant is being consumed. This information can be transmitted to a controller or control area. Each tank is capable of being filled pneumatically and can be emptied through a calibrated discharge chute by gravity. Gravity can be the substantial means of delivering proppant from the proppant tank. The tanks may also be agitated in the event of clogging or unbalanced flow. The proppant tanks can contain a controlled, calibrated orifice. Each tank's level, material weight, and calibrated orifice can be used to monitor and control the amount of desired proppant delivered to the blending unit. For instance, each tank's orifice can be adjusted to release proppant at faster or slower rates depending upon the needs of the formation and to adjust for the flow rates measured by the change in weight of the tank. Each proppant tank can contain its own air ventilation and filtering. In reference to FIG. 8, the tanks 106 can be arranged around each blending unit 105 within the enclosure, with each tank's discharge chute 803 located above the blending unit 105. The discharge chute can be connected to a surge hopper 804. In one embodiment, proppant is released from the proppant storage unit 106 through a controllable gate in the unit. When the gate is open, proppant travels from the proppant storage unit into the discharge chute 803. The discharge chute releases the proppant into the surge hopper. In this embodiment, the surge hopper contains a controlled, calibrated orifice or aperture 807 that releases proppant from the surge hopper at a desired rate. The amount of proppant in the surge hopper is maintained at a substantially constant level. Each tank can be connected to a pneumatic refill line 805. The tanks' weight can be measured by a measurement lattice 806 or by weight sensors or scales. The weight of the tanks can be used to determine how much proppant is being used during a well stimulation operation, how much total proppant was used at the completion of a well stimulation operation, and how much proppant remains in the storage unit at any given time. Tanks may be added to or removed from the storage system as needed. Empty storage tanks may be in the process of being filled by proppant at the same time full or partially full tanks are being used, allowing for continuous operation. The tanks can be arranged around a calibrated v-belt conveyor. In addition, a resin-coated proppant may be used by the addition of a mechanical proppant coating system. The coating system may be a Muller System.

In one embodiment, the chemical storage system 112 is connected to the blending unit and can include tanks for breakers, gel additives, crosslinkers, and liquid gel concentrate. The tanks can have level control systems such as a wireless hydrostatic pressure system and may be insulated and heated. Pressurized tanks may be used to provide positive pressure displacement to move chemicals, and some tanks may be agitated and circulated. The chemical storage system can continuously meter chemicals through the use of additive pumps which are able to meter chemical solutions to the blending unit 105 at specified rates as determined by the required final concentrations and the pump rates of the main treatment fluid from the blending unit. The chemical storage tanks can include weight sensors that can continuously monitor the weight of the tanks and determine the quantity of chemicals used by mass or weight in real-time, as the chemicals are being used to manufacture well treatment fluid. Chemical storage tanks can be pressurized using compressed air or nitrogen. They can also be pressurized using variable speed pumps using positive displacement to drive fluid flow. The quantities and rates of chemicals added to the main fluid stream are controlled by valve-metering control systems. The valve-metering can be magnetic mass or volumetric mass meters. In addition, chemical additives could be added to the main treatment fluid via aspiration (Venturi Effect). The rates that the chemical additives are aspirated into the main fluid stream can be controlled via adjustable, calibrated apertures located between the chemical storage tank and the main fluid stream. In the case of fracturing operations, the main fluid stream may be either the main fracture fluid being pumped or may be a slip stream off of a main fracture fluid stream. In one embodiment, the components of the chemical storage system are modularized allowing pumps, tanks, or blenders to be added or removed independently.

Figure 2:
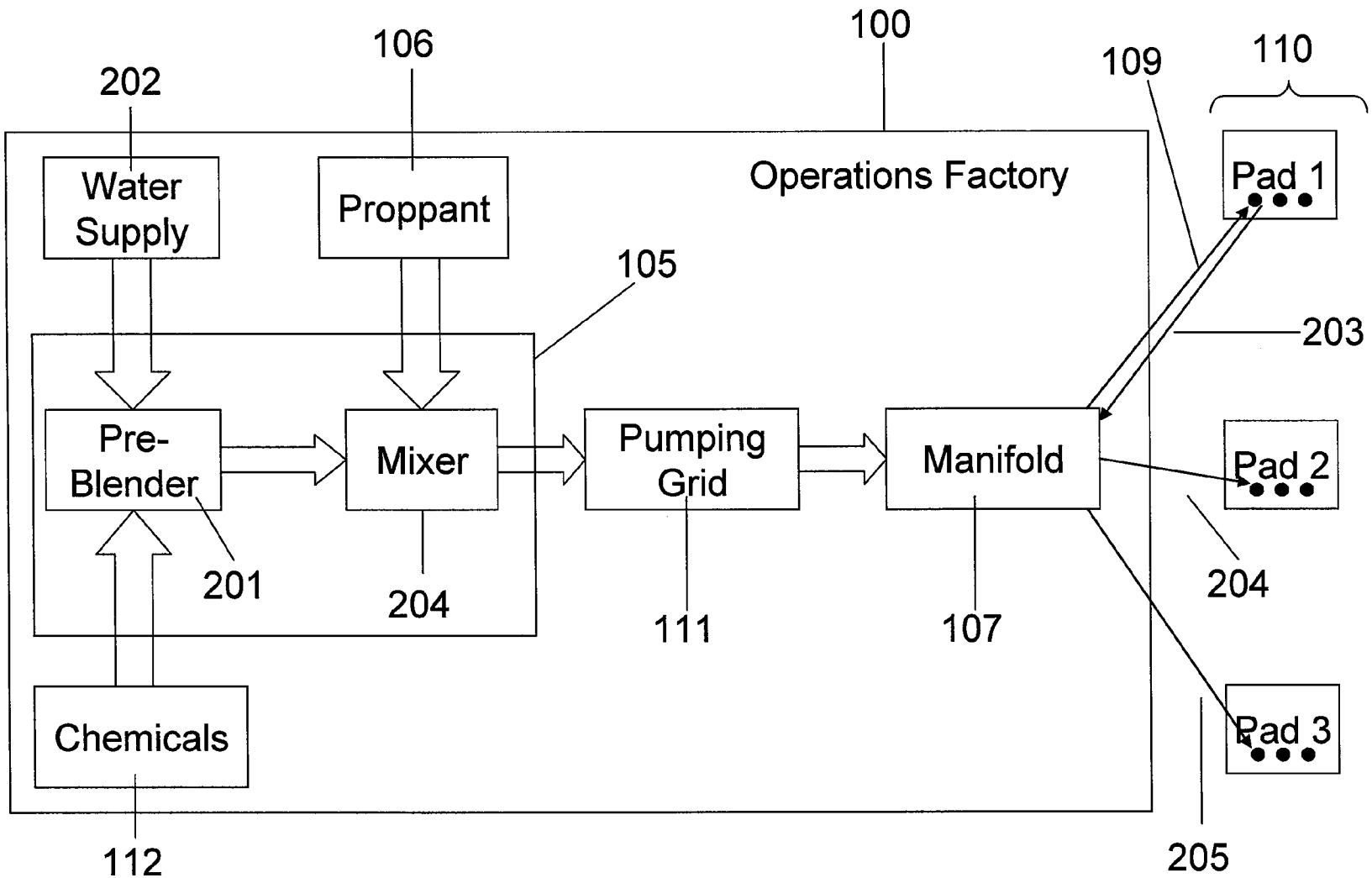
FIG. 2 is a flow diagram of a centralized well treatment facility.

In reference to FIG. 2, in one embodiment, the blending unit 105 is connected to the chemical storage system 112, the proppant storage system 106, a water source 202, and a pumping grid 111 and may prepare a fracturing fluid, complete with proppant and chemical additives or modifiers, by mixing and blending fluids and chemicals at continuous rates according to the needs of a well formation. The blending unit 105 comprises a preblending unit 201 wherein water is fed from a water supply 202 and dry powder (guar) or liquid gel concentrate can be metered from a storage tank by way of a screw conveyor or pump into the preblender's fluid stream where it is mixed with water and blended with various chemical additives and modifiers provided by the chemical storage system 112. These chemicals may include crosslinkers, gelling agents, viscosity altering chemicals, PH buffers, modifiers, surfactants, breakers, and stabilizers. This mixture is fed into the blending unit's hydration device, which provides a first-in-first-out laminar flow. This now near fully hydrated fluid stream is blended in the mixer 204 of the blending unit 105 with proppant from the proppant storage system to create the final fracturing fluid. This process can be accomplished at downhole pump rates. The blending unit can modularized allowing its components to be easily replaced. In one embodiment, the mixing apparatus is a modified Halliburton Growler mixer modified to blend proppant and chemical additives to the base fluid without destroying the base fluid properties but still providing ample energy for the blending of proppant into a near fully hydrated fracturing fluid. The final fluid can be directed to a pumping grid 111 and subsequently directed to a central manifold 107, which can connect and direct the fluid via connection 109, 204, or 205 to multiple wells 110 simultaneously. In one embodiment, the fracturing operations factory can comprise one or more blending units each coupled to one or more of the control units, proppant storage system, the chemical storage system, the pre-gel blending unit, a water supply, the power unit, and the pumping grid. Each blending unit can be used substantially simultaneously with any other blending unit and can be blending well treatment fluid of the same or different composition than any other blending unit.

In one embodiment, the blending unit does not comprise a pre-blending unit. Instead, the fracturing operations factory contains a separate pre-gel blending unit. The pre-gel blending unit is fed from a water supply and dry powder (guar) can be metered from a storage tank into the preblender's fluid stream where it is mixed with water and blended and can be subsequently transferred to the blending unit. The pre-gel blending unit can be modular, can also be enclosed in the factory, and can be connected to the central control system.

In one embodiment of the pumping grid 111, the grid comprises one or more pumps that can be electric, gas, diesel, or natural gas powered. The grid can also contain spaces operable to receive equipment, such as pumps and other devices, modularized to fit within such spaces. The grid can be prewired and preplumbed and can contain lube oil and cooling capabilities. The grid is operable to accept connections to proppant storage and metering systems, chemical storage and metering systems, and blending units. The pumping grid can also have a crane that can assist in the replacement or movement of pumps, manifolds, or other equipment. A central manifold 107 can accept connections to wells and can be connected to the pumping grid. In one embodiment, the central manifold and pumping grid are operable to simultaneously treat both a first well head connected via a first connection and a second well head connected via a second connection with the stimulation fluid manufactured by the factory and connected to the pumping grid.

In some embodiments, the operations of the chemical storage system, proppant storage system, blending unit, pumping grid, power unit, and manifolds are controlled, coordinated, and monitored by a central control system. The central control system can be an electronic computer system capable of receiving analog or digital signals from sensors and capable of driving digital, analog, or other variety of controls of the various components in the fracturing operations factory. The control system can be located within the factory enclosure, if any, or it can be located at a remote location. The central control system may use all of the sensor data from all units and the drive signals from their individual subcontrollers to determine subsystem trajectories. For example, control over the manufacture, pumping, gelling, blending, and resin coating of proppant by the control system can be driven by well formation needs such as flow rate. Control can also be driven by external factors affecting the subunits such as dynamic or steady-state bottlenecks. Control can be exercised substantially simultaneously with both the determination of a desired product property, or with altering external conditions. The control system will substantially simultaneously cause the delivery of the proppant and chemical components comprising a well treatment fluid with the desired property at the desired rate to the blending unit where it can be immediately pumped to the desired well location. Well treatment fluids of different compositions can also be manufactured substantially simultaneously with one another and substantially simultaneously with the determination of desired product properties and flow rates through the use and control of multiple blending units each connected to the control unit, proppant storage system, chemical storage system, water source, and power unit. The central control system can include such features as: (1) virtual inertia, whereby the rates of the subsystems (chemical, proppant, power, etc.) are coupled despite differing individual responses; (2) backward capacitance control, whereby the tub level controls cascade backward through the system; (3) volumetric observer, whereby sand rate errors are decoupled and proportional ration control is allowed without steady-state error. The central control system can also be used to monitor equipment health and status. Simultaneously with the manufacture of a well treatment fluid, the control system can report the quantity and rate usage of each component comprising the fluid. For instance, the rate or total amount of proppant, chemicals, water, or electricity consumed for a given well in an operation over any time period can be immediately reported both during and after the operation. This information can be coordinated with cost schedules or billing schedules to immediately compute and report incremental or total costs of operation.

Figure 3:
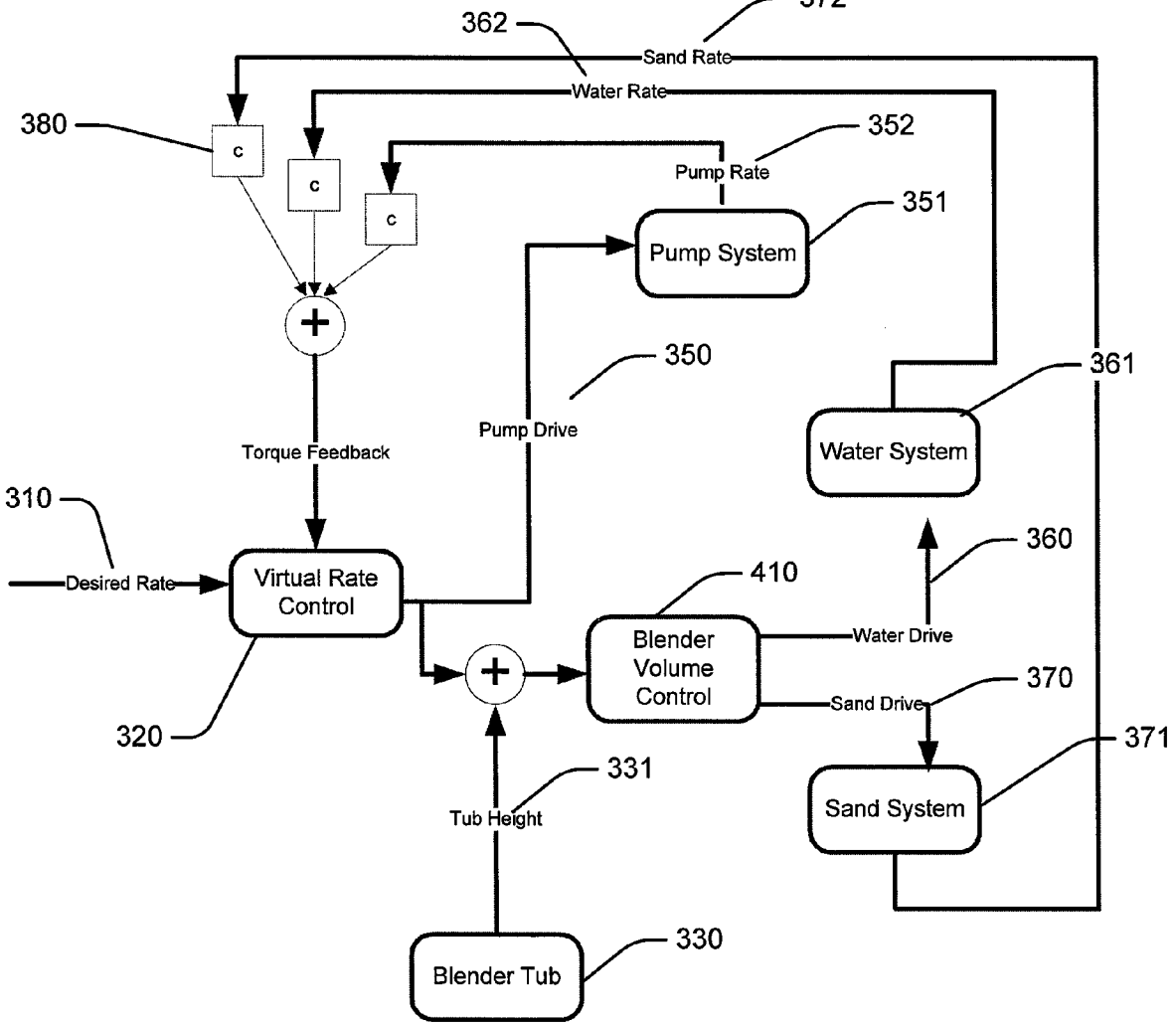
FIG. 3 is a diagram of a well treatment control system with a blender volume control.

In reference to FIG. 3, in one embodiment of the control system, a desired property 310 of well treatment fluid to be pumped into a well is determined by any particular needs of a well formation. Property 310 can be a rate at which well treatment fluid is desired to be pumped into a well formation measured in gallons per second, for example, or kilograms per second or any other mass or volumetric rate. In the case that a desired rate is used, rate 310 is entered into a virtual rate control 320, causing the control system 320 to drive the output rate of the fracturing operations factory to the desired rate. This may be done, for example, by increasing or decreasing the rates of one or more of the various subsystem components depending on whether the subsystem's output is in line with the desired rate 310. The virtual rate control 320 can be implemented in hardware or software in a stand alone computer or ASIC, or within any of the systems used to control the pumping system 351, water system 361, or proppant or sand system 371. In this disclosure, the terms sand and proppant are used synonymously. The virtual rate control can be programmed with transfer functions that can relate the desired rate 310 to a pump drive signal 350. The transfer functions can account for the particular type of pumping, water, or sand systems being implemented and can adjust the drive signals according to feedback signals 352, 362, and 372 and sensor data from the blending unit 105 (also called the blender tub), such as the tub height 331.

In certain embodiments, the virtual rate control 320 system is a closed-loop feedback system in which the rate at which the system operates is determined by processing the desired rate 310. More specifically, the system's current rate 350 is subtracted from the desired rate 310, and this difference, an error, is multiplied by a proportionality constant. The result of this multiplication may, in certain embodiments, be reduced by a level of torque feedback from the various subsystem controllers, to be described in more detail below. After this addition (or subtraction) of the torque feedback, if any, the result is then multiplied by another constant which represents the virtual "inertia" of the system, i.e., the rate at which the output signals may be changed in order to reach the desired rate. Finally, the result of this operation is integrated with respect to time to obtain the rate at which the system will operate.

An equation to represent the preceding operations may be noted as follows:

$$\int \frac{K_p * (R_d - R_c) - T}{J} dt$$

The current rate 350 is calculated as follows: with Kp being a proportionality constant for the virtual rate control 320, Rd being the desired rate 310, Rc being the previously calculated current rate 350, T being torque feedback from various subsystem controllers, and J being a constant that represent the virtual "inertia" of the system. The virtual inertia J controls how fast the system will change in rate. It represents the constant controlling the dynamic response of the open loop virtual system. The torque feedback T will push on the virtual inertia. If it is large, it will take more time to speed up the fracturing operations factory then if the torque T is small. In some embodiments, the virtual inertia can be chosen to be approximately the speed of the slowest actuator in the fracturing operations factory, which will minimize the need for the virtual torque feedback to change the rate of the system. The virtual rate control constant Kp controls how hard the virtual inertia is pushed to speed it up or slow it down assuming there is no virtual torque feedback T. The virtual rate control constant Kp with the virtual inertia constant J can determine the closed loop response of the system. The transfer functions implemented in the virtual control 320 are a result of the operations denoted above, and may be altered by adding, removing, or altering the series of operations the desired rate undergoes in order to produce the system's final overall rate. These transfer functions may adjust the drive signals according to feedback signals 352, 362, and 372.

The output of the virtual rate control 320 system is the pump drive signal 350. In the case that the desired property 310 is a rate, the pump drive signal 350 drives the pumping system at a rate equal to the total rate at which the system must operate, the rate obtained as the end product of processing the desired rate as described above. Pump drive signal 350 drives the pumping system to the rate that fracturing fluid, for instance, is required to be delivered down hole. Drive signal 350 is sent to both the pump system 351 and the blender volume control 410 because whatever is mixed by the blender volume control system and the subsystems it controls must also be pumped by the pump system at the rates demanded by the virtual rate control 320.

The pump drive signal 350 is sent from the virtual rate control 320 to the pump systems 351. The pump system, like all of the subsystems in this disclosure, has its own controller, implemented in some embodiments in a computer. The total pump rate 352 of the pump system is determined by processing or adjusting the pump drive signal 350. As stated above, in some embodiments, the pump drive signal 350 is the total rate of the system. In embodiments containing multiple pumps, each pump has its own automated system with controllers, and the pump drive signal is split between all the pumps. This splitting occurs depending on the pump type and its best operating conditions. The automated system at each pump will then pump in order to meet that pump's rate set point. In some embodiments of the pump system, the pump drive signal is multiplied by a set of proportionality constants, each pump having its own constant, such that these proportionality constants are fractions which add to 1. In these embodiments, the total pump rate 352, the sum of all the pump system sub-rates, equals the total rate represented by the pump drive signal 350.

A blender volume control 410 generates the water drive signal 360 and sand drive signal 370. The blender volume control 410 controls the volume of sand, water, and/or other chemicals contained in the blender tub 330. In some embodiments, blender volume control 410 receives the sum of pump drive signal 350 from virtual rate control 320 and a blender tub height signal 331. The blender tub height signal 331 comes from a tub height control system, which may be a proportional controller or a proportional and integral controller. This tub height control system may take in a desired tub height value and process it to obtain an actual height for the tub. The desired tub height is chosen such that the tub level is neither too low nor overflowing, and this value is often 2 feet below the top of the tub. In certain embodiments, the tub height control system may look at the difference, or error, between the desired tub height and the actual tub height and multiply it by a proportionality constant. That is, tub height 331 equals:

$$(H_d - H_a)K_t$$

With $H_d$ being the desired tub height, Ha being the actual tub height, and Kt being the proportionality constant for the blender tub. This value summed with the pump drive signal 350 produced by the virtual rate control is the total rate at which the blender volume control subsystem should operate so that the tub height can reach the desired height. A system for use as a blender tub height controller is described in detail in U.S. Patent Application Number 20060161358. An advantage of the system created is that since the subsystems are working in unison, the blender tub height level is typically very stable and is not driven by error alone. Blender volume control 410 can include transfer functions that can generate the water drive signal 360 and sand drive signal 370 based on the pump drive signal 350 and the tub height that depend on the particular properties of the water, sand, and tub systems implemented. The blender volume controller system may be a proportional or integral controller or the blender volumetric observer system for volumetric control, an embodiment found in U.S. patent application Ser. Nos. 11/323,831 and 11/323,323. In embodiments where the blender volume controller is a proportional controller, the pump drive signal and tub height are multiplied either individually or as a sum by one or more constants to produce the water and sand drive signals. It should be noted that the water drive signal and sand drive signal need not be equal, allowing active control of the ratio of the elements in the blender tub.

The pump rate feedback signal 352 can be generated by pressure sensors or pump sensors at the well pump or pumps and communicated to the virtual rate control 320 via ethernet, for example, or any other electronic communication means. The water rate feedback signal 362 can indicate the rate of water entering the blender tub and can be generated by sensors at a water valve and communicated the same way to the virtual rate control 320. The sand rate feedback signal 372 can indicate the rate of sand entering the blender tub and can be generated by sensors measuring the changes in the sand tub height and also communicated the same way to the virtual rate control 320. The sand rate can also be determined using a densometer alone or in conjunction with a speed sensor on the sand screw. These feedback signals will be detailed further below. With respect to the pumping system 351, the pump drive signal 350 can control the pumping pressure or pumping rate of the pumps driving the well treatment fluid into a well. The water drive signal 360 can control the valves of the water source to the blending tub to control the rate of water entering the tub and/or volume of water in the tub. The sand drive signal 370 can control the speed of the sand screw delivering sand to the blender tub. These drive signals can directly connect to the pumps, water valves, or sand screw motors, for example, or can be connected by any information connection, such as ethernet, to a computer or other system that controls the pumps, water valves, or sand screw. In this way, the virtual rate control can drive each input system in the manufacturing of well treatment fluid to perform at level such that the desired rate 310 can maintained while taking into account any variations in performance from any one of the systems. If, for instance, the tub level has become too low according to one set of transfer functions to maintain the desired rate 310, the blender volume control 410 can adjust the water drive signal 360 and sand drive signal 370 according to the pump drive signal 350 and tub height 331 to increase the amount of sand and water being delivered to the tub. In this way, the performance of the fracturing operations factory is coordinated and remains consistent.

Figure 4:
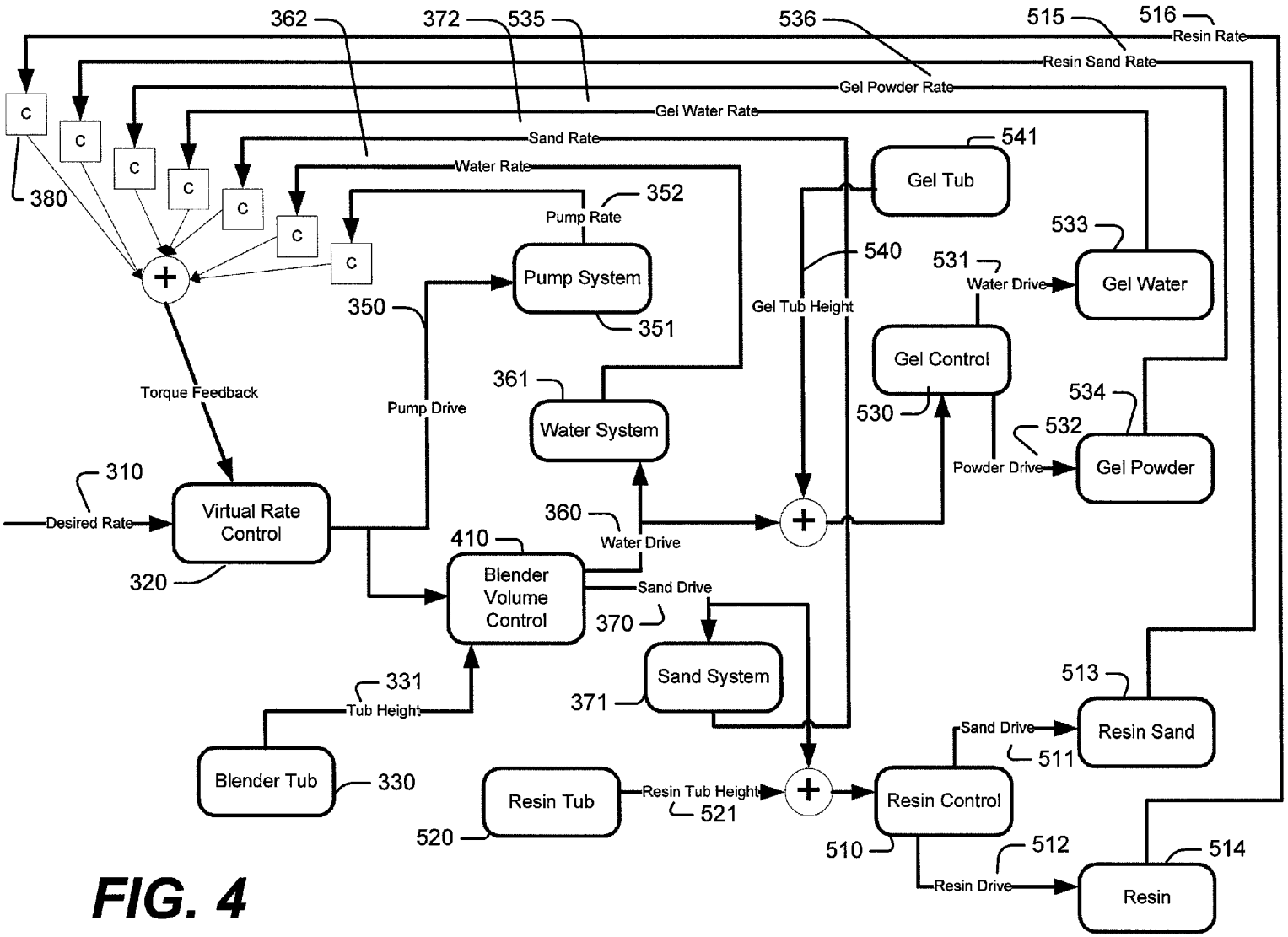
FIG. 4 is a diagram of a well treatment control system with a gel control and resin control.

In reference to FIG. 4, in one embodiment of the control system, resin control system 510 and gel control system 530 can be included with the control system. The resin control system 510 and gel control system 530 can be implemented within the control system in hardware or software in a stand alone computer or ASIC. In this way, the amount of resin and gel in a well treatment fluid can also be controlled using the virtual rate control so that the performance of the gel and resin systems can be coordinated and remain consistent with the desired property 310. In this embodiment, the blender volume control 410, water system 361, sand system 371, and pump system 351 operate in the same way as in FIG. 3. The gel control 530 can accept the water drive signal 360 summed with a gel tub height signal 540. The gel control system receives the water drive signal (which is adjusted by the gel tub height signal) because the gel must supply a certain amount of water. The gel tub height signal 540 comes from a tub height control system 541, which may be a proportional controller or a proportional and integral controller. This tub height control system may take in a desired tub height value and process it to obtain an actual height for the tub. The desired tub height is chosen such that the tub level is neither too low nor overflowing, and this value is often 2 feet below the top of the tub. In certain embodiments, the tub height control system may look at the difference, or error, between the desired tub height and the actual tub height and multiply it by a proportionality constant. That is, tub height 540 equals $$(H_d - H_a)K_t$$

With Hd being the desired tub height, Ha being the actual tub height, and Kt being the proportionality constant for the gel tub. This value summed with the water drive signal 360 produced by the blender volume control is the total rate at which the gel control subsystem should operate. A system for use as a gel tub height controller is described in detail in U.S. Patent Application Number 20060161358. Because the subsystems are working in unison, the gel tub height level is typically very stable and does not try to follow error. Additionally, by taking into account both the blender tub level and the gel tub level, the operating rate is adjusted in a manner such that both tubs are at a desirable level while trying to achieve the rate specified. The gel control system can take the summed water drive signal and gel tub height signal and apply a transfer function to the water drive signal 360 and the gel tub height signal 540 to create a gel water drive signal 531 and gel powder drive signal 532. The transfer function is particular to the specific implementation of the gel water and gel powder systems used and relates a given water drive signal and gel tub height to particular drive values for the gel water and gel powder. In other embodiments, liquid gel concentrate may be used and drive signal 532 can be a liquid gel concentrate drive signal controlling a valve. The gel water system may be implemented using a pressurize tank and valve combination, for instance, and the gel powder system may use a particular size powder container and conveyor screw. The gel tub contains the mixed gel before it is delivered to the blender tub and the gel tub height signal 540 can be generated from a level sensor within the gel tub. Water, controlled by gel water system 533, and gel powder, controlled by gel powder system 534, are added and mixed in the gel tub 541 to form the gel mixture. Like the water, sand and pump drive signals, the gel water drive signal 531 and gel powder drive signal 532 can control a gel water valve and gel screw directly, or can interface with any control system used by the gel water 533 and gel powder 534. In some embodiments, the gel water drive signal and the gel powder drive signal produced by the gel control system are each produced by multiplying the water drive signal by a proportionality constant. In other embodiments, these signals may be produced using a transfer function in the gel control which takes into account properties such as viscosity. This may be accomplished by using a controller as described in U.S. patent application Ser. Nos. 11/323,322 or 11/323,324.

In addition, in reference to FIG. 4, resin control 510 can be incorporated into the control system. Resin control 510 receives sand drive signal 360 summed with resin tub height 521. The resin control system receives the sand drive signal (adjusted by the resin tub height) because the resin must supply a certain amount of sand. The resin tub height signal 521 comes from a tub height control system, which may be a proportional controller or a proportional and integral controller. This tub height control system may take in a desired tub height value and process it to obtain an actual height for the tub. The desired tub height is chosen such that the tub level is neither too low nor overflowing, and this value is often 2 feet below the top of the tub. In certain embodiments, the tub height control system may look at the difference, or error, between the desired tub height and the actual tub height and multiply it by a proportionality constant. That is, tub height 521 equals $$(H_d - H_a)K_t$$

With Hd being the desired tub height, Ha being the actual tub height, and Kt being the proportionality constant for the resin tub. This value summed with the sand drive signal 370 produced by the blender volume control is the total rate at which the resin control subsystem should operate. A system for use as a resin tub height controller is described in detail in U.S. Patent Application Number 20060161358. Because the subsystems are working in unison, the resin tub height level is typically very stable and does not try to follow error. Additionally, by taking into account both the blender tub level and the resin tub level, the operating rate is adjusted in a manner such that both tubs are at a safe level. The resin control system can take the summed sand drive signal and resin tub height signal and applies a transfer function to generate a resin sand drive signal 511 and a resin drive signal 512. The resin tub 520 receives and mixes sand and resin delivered from resin sand system 513 and resin system 514. The resin control 510 can receive the sand drive signal 370 and the resin tub height 521 and apply a transfer function to generate resin sand drive signal 511 and resin drive signal 512. The transfer function is particular to the specific implementation of the resin sand and resin systems used and relates a given sand drive signal and resin tub heights to particular drive values for the resin sand and resin. The resin tub contains the mixed resin and sand before it is delivered to the blender tub. Sand, controlled by resin sand system 513, and resin, controlled by resin system 514, are added and mixed in the resin tub 520. Like the water, sand and pump drive signals, the resin sand drive signal 513 and resin drive signal 512 can control the resin valve and sand screw (which gets its sand from the resin tub) directly, or can interface with any control system used by resin sand system 513 and resin system 514. In some embodiments, the resin sand drive signal and the resin drive signal produced by the resin control system are each produced by multiplying the sand drive signal by a proportionality constant. In other embodiments, these signals may be produced using a transfer function in the resin control that takes into account properties such as viscosity. This may be accomplished by using a controller described in U.S. patent application Ser. Nos. 11/323,322 or 11/323,324.

In some embodiments, the addition of the resin control and gel control allows for the desired property 310 to be a desired gel or resin composition of the well fracturing fluid. A sensor or sensors in the blender tub can measure the gel or resin composition of the fracturing fluid as it is being pumped into a well. This data can be entered into the virtual rate control 320 or the blender volume control 410 according to method and apparatus described above so that the appropriate water, sand, resin, and gel drive signals can maintain operational consistency with the desired resin and gel composition of the well treatment fluid. It should be noted that the sum of all of the input rates to all of the actuators in the system (in terms of volume) must equal the sum of the virtual pump output rates. By driving the input systems of a well treatment operation according to a virtual rate control that takes into account a desired rate and feedback signals of the current rates of the input systems, the operation of a well treatment operation can be coordinated and consistent performance can be maintained across the various subsystems. Once the subsystems and their actuators produce their respective rates, such as the pump rate 352, the water rate 362, the sand rate 372, the gel water rate 535, the gel powder rate 536, the resin sand rate 515 and the resin rate 516, these outputs are converted back to virtual torque feedback at converters 380 in a manner which preserves their relative importance (or weights) in the overall system such that they may be properly compared. The virtual torque feedback is used to couple the subsystems so that they have a response time close to the slowest subsystem. In FIG. 3, it is shown that the torque feedback is fed into the virtual rate control 320. All of the subsystem torque feedbacks are first summed and then fed into the virtual rate control system, as described above. The purpose of torque feedback is to ensure that the rate of change of the overall system is not greater than the rate of change of the slowest subsystem. It should be noted that the actuators in each subsystem, such as the pump actuators or water system actuators, each have their own proportional integral controllers, each measuring their own speed and trying to match their own rates. Additionally, each of these controllers is producing an output drive signal which is monitored via the converted signals of the torque feedback.

The present invention can be used both for onshore and offshore operations using existing or specialized equipment or a combination of both. Such equipment can be modularized to expedite installation or replacement. The present invention may be enclosed in a permanent, semipermanent, or mobile structure.

As those of ordinary skill in the art will appreciate, the present invention can be adapted for multiple uses. By way of example only, the control system can maintain the water systems, proppant or sand systems, resin systems, and gel systems operating at performance levels consistent with the desired rate and properties of fracturing fluid delivered to a well location. The invention is capable of considerable additional modification, alteration, and equivalents in form and function, as will occur to those ordinarily skilled in the art having the benefit of this disclosure. The depicted and described embodiments of the invention are exemplary only, and are not exhaustive of the scope of the invention. Consequently, the invention is intended to be limited only by the spirit and scope of the appended claims.

What is claimed is:

1. A method for controlling the production of well treatment fluid comprising:

determining an output rate from a sand system;

sensing an output rate from a water system;

sensing an output rate from a pumping system;

sensing the height within a blender tub of a mixture of sand from the sand system and water from the water system;

providing a virtual rate control system; and producing a drive signal to the pumping system using the virtual rate control system using a desired rate of well treatment fluid to be delivered to a well, the output rate of the sand system, the output rate of the water system, and the output rate of the pumping system.

2. The method of claim 1 comprising producing a drive signal to the pumping system by:

producing a first difference by subtracting the output rate of the pumping system by the desired rate;

producing a product by multiplying the first difference by a proportionality constant associated with the virtual rate control;

producing a second difference by subtracting from the product a torque feedback, the torque feedback being generated from the output rate of the sand system, the output rate of the water system, and the output rate of the pumping system;

producing a second product by multiplying said second difference by a virtual inertia constant; and integrating said second product with respect to time.

3. The method of claim 1 further comprising:

producing a drive signal to the sand system using a blender volume control system based on a predetermined relationship between the drive signal to the pumping system and the height of contents of the blender tub; and producing a drive signal to the water system using the blender volume control system based on a predetermined relationship between the drive signal to the pumping system and the height of contents in the blender tub.

4. The method of claim 3 further comprising producing a gel control signal using a height of contents in a gel tub and the drive signal to the water system.

5. The method of claim 4 further comprising:

producing a drive signal to a gel water system using a gel control system based on a predetermined relationship between the gel control signal and the drive signal to the gel water system; and producing a drive signal to a gel system using a gel control system based on a predetermined relationship between the gel control signal and the drive signal to the gel system.

6. The method of claim 3 further comprising producing a resin control signal using a height of contents in a resin tub and the drive signal to the sand system.

7. The method of claim 6 further comprising:

producing a drive signal to a resin sand system using a resin control based on a predetermined relationship between the resin control signal and the drive signal to the resin sand system; and producing a drive signal to a resin system using a resin control based on a predetermined relationship between the resin control signal and the drive signal to the resin system.

8. An apparatus for controlling the production of well treatment fluid at a predetermined rate comprising:

a sand system with a means for determining an output rate of the sand system;

a water system with an output rate sensor;

a pumping system with an output rate sensor;

a blender tub with a height sensor, wherein the blender tub is connected to the sand system and water system and receives sand from the sand system and water from the water system; and a virtual rate control system, wherein the virtual rate control system is operable to:

produce a drive signal to the pumping system using a desired rate of well treatment fluid to be delivered to a well, the output rate of the sand system, the output rate of the water system, and the output rate of the pumping system.

9. The apparatus of claim 8 wherein the virtual rate control system produces the drive signal to the pumping system by:

producing a first difference by subtracting the output rate of the pumping system by the desired rate;

producing a product by multiplying the first difference by a proportionality constant associated with the virtual rate control;

producing a second difference by subtracting from the product a torque feedback, the torque feedback being generated from the output rate of the sand system, the output rate of the water system, and the output rate of the pumping system;

producing a second product by multiplying said second difference by a virtual inertia constant; and integrating said second product with respect to time.

10. The apparatus of claim 8 further comprising a blender volume control system, wherein the blender volume control system is operable to:

produce a drive signal to the sand system based on a predetermined relationship between a desired rate of well treatment fluid to be delivered to a well, the height of contents in the blender tub, the output rate of the sand system, the output rate of the water system, and the output rate of the pumping system; and produce a drive signal to the water system based on a predetermined relationship between a desired rate of well treatment fluid to be delivered to a well, the height of contents in the blender tub, the output rate of the sand system, the output rate of the water system, and the output rate of the pumping system.

11. The apparatus of claim 10 further comprising a gel control system and a gel system comprising a gel tub, a gel tub height sensor, a gel water valve, a gel water rate sensor, a gel delivery system, and a gel level sensor.

12. The apparatus of claim 11 wherein the gel control system is operable to:

transmit a gel rate and a gel water rate to the virtual rate control;

produce a drive signal to a gel water system based on a predetermined relationship between the gel control signal and the drive signal to the gel water system; and produce a drive signal to a gel delivery system based on a predetermined relationship between the gel control signal and the drive signal to the gel delivery system.

13. The apparatus of claim 11 further comprising a resin control system and a resin system comprising a resin tub, a resin tub height sensor, a resin valve, a resin rate sensor, a resin sand system, and a resin sand rate sensor.

14. The apparatus of claim 13 wherein the resin control system is operable to:

transmit a resin sand rate and a resin water rate to the virtual rate control;

produce a drive signal to the resin sand system based on a predetermined relationship between the resin control signal and the drive signal to the resin sand system; and produce a drive signal to the resin system based on a predetermined relationship between the resin control signal and the drive signal to the resin system.

* * * * *